US009644325B2

(12) United States Patent
Mancic et al.

(10) Patent No.: US 9,644,325 B2
(45) Date of Patent: May 9, 2017

(54) CROSS-OVER SWITCH FOR A MONORAIL

(71) Applicant: Bombardier Transportation GmbH, Berlin (DE)

(72) Inventors: Aleksandar Mancic, Kingston (CA); Peter Edward Timan, Sydenham (CA)

(73) Assignee: Bombardier Transportation GmbH, Berlin (DE)

( * ) Notice: Subject to any disclaimer, the term of this patent is extended or adjusted under 35 U.S.C. 154(b) by 152 days.

(21) Appl. No.: 14/626,990

(22) Filed: Feb. 20, 2015

(65) Prior Publication Data

US 2015/0308052 A1 Oct. 29, 2015

Related U.S. Application Data

(60) Provisional application No. 61/985,741, filed on Apr. 29, 2014.

(51) Int. Cl.
*E01B 25/12* (2006.01)

(52) U.S. Cl.
CPC ..... *E01B 25/12* (2013.01)

(58) Field of Classification Search
CPC . E01B 7/00; E01B 25/06; E01B 25/22; E01B 25/00; E01B 7/06; E01B 25/12; E01B 25/26; E01B 25/34
See application file for complete search history.

(56) References Cited

U.S. PATENT DOCUMENTS

| | | | | |
|---|---|---|---|---|
| 3,426,703 A | | 2/1969 | Morris | |
| 4,016,818 A | | 4/1977 | Ellzey | |
| 5,582,108 A | | 12/1996 | Benenowski et al. | |
| 5,687,649 A | * | 11/1997 | Koeninger | E01B 25/24 104/106 |
| 8,215,591 B2 | | 7/2012 | Roop | |
| 2003/0154878 A1 | * | 8/2003 | Fichtner | E01B 25/34 104/130.11 |

FOREIGN PATENT DOCUMENTS

| | | | |
|---|---|---|---|
| DE | 1739034 U | | 2/1957 |
| DE | 3423423 A1 | | 1/1986 |
| DE | 42 02 131 | * | 7/1993 |
| GB | 827969 | * | 2/1960 |

* cited by examiner

*Primary Examiner* — Mark Le
(74) *Attorney, Agent, or Firm* — The Webb Law Firm

(57) ABSTRACT

A cross-over switch system for switching a monorail vehicle between two fixed guideway beams is provided. The cross-over switch system includes two articulated beams and a median beam. Each one of the two articulated beams, constructed of a chain of pivotably interconnected segments, and is pivotably connected to a different one of the two parallel fixed guideways. The median beam, which is pivotable in its center, is located at a median distance between the two parallel fixed guideway beams. When in a switching mode, the median beam is pivoted and each segment of each articulated beam is also pivoted so that each one of the articulated beam abuts an opposed end of the median beam.

10 Claims, 7 Drawing Sheets

CROSS-OVER SWITCH FOR A MONORAIL

CROSS REFERENCE TO RELATED APPLICATION

This application claims the benefit of U.S. Provisional Application No. 61/985,741, filed Apr. 29, 2014, which is incorporated herein by reference.

BACKGROUND OF THE INVENTION

Field of the Invention

The present invention generally relates to the field of guideway switches. More specifically, the invention relates to a cross-over guideway switch system for a monorail permitting switching the monorail vehicle between two parallel fixed guideway beams.

Description of Related Art

Cross-over guideway switches for monorails are large moveable pieces of infrastructure. Typical installations of cross-over guideway switches use a two oppositely curved replacement beams that move out of the way when the switch adopts a non-switching position and that replace a corresponding pivotable straight portion of each parallel guideway beams when adopting a switching position. When in the non-switching position, the curved replacement beams are positioned in between the two parallel guideway beams, at a safe distance that prevents contact with a monorail vehicle travelling on the guideway beams. This dictates a minimum distance between the two parallel guideway beams. When adopting the switching position, the two pivotable straight portions of the guideway beams must be moved out of the way towards the exterior of the guideway beams. This takes up much space and makes for a large and expensive cross-over switch installation.

There is therefore a need for an improved cross-over switch for a monorail.

SUMMARY OF THE INVENTION

It is an object of the present invention to provide a cross-over switch for a monorail that overcomes or mitigates one or more disadvantages of known cross-over switches for monorails, or at least provides a useful alternative.

The invention provides the advantages of taking less space than a standard cross-over switch for monorails.

In accordance with an embodiment of the present invention, there is provided a cross-over switch system for switching a monorail vehicle between two fixed guideway beams. Each one of the two fixed guideway beams has a discontinuity, the discontinuities being longitudinally staggered with respect to each other. The cross-over switch system comprises two articulated beams and a median beam. Each one of the two articulated beams is made of a chain of pivotably interconnected segments. Each articulated beam is adapted to be pivotably connected to a different one of the two fixed guideways at an end of its respective discontinuity that is distal from a median pivot point on which the median beam pivots. The median beam is located at a laterally median distance between the two fixed guideway beams and at a longitudinal median distance between the discontinuities. When in a non-switching mode, the median beam is parallel to the two parallel fixed guideway beams and the two articulated beams are aligned with the respective parallel fixed guideway beam to which they are connected so as to each form a straight beam. In a switching mode, the median beam is pivoted and each segment of each articulated beam is pivoted so that each one of said articulated beam abuts an opposed end of said median beam, thereby forming a continuous segmented beam interconnecting the two parallel fixed guideway beams.

Optionally, the segments may be made of aluminum, steel or concrete. If made of aluminum, an aluminum extrusion may be used.

The median beam may be straight or curved in the shape of a wave or "S".

In another embodiment called a double cross-over switch, each one of the two fixed guideway beams is provided with two discontinuities. In this case, the cross-over switch comprises two pairs of articulated beams. Each one of the pair of articulated beams is connected to a different one of the two fixed guideway beams. Each articulated beam of each one of the two pairs of articulated beams is connected at one end of a different discontinuity that is distal the median pivot point, thereby creating the double cross-over switch.

In case there is not sufficient clearance between the fixed guideway beam and the continuous segmented beam formed when the cross-over switch system is in the switching mode, the cross-over switch may further comprise two clearance segments. Each clearance segment is adapted to be pivotably connected at a different one of the two fixed guideway beams at an end of the discontinuities that is proximate the median pivot point. Each clearance segment may be operated either by a linkage or by an actuator. If operated by the linkage, each one of the two linkages is connected between the median beam and a respective clearance segment. Each linkage is connected at an opposed longitudinal half of the median beam. If operated by the actuator, each actuators is connected between a different one of the guideways and a corresponding clearance segment. Hence, when in the non-switching mode, the two clearance beams are aligned with the two parallel guideway beams and form a continuous beam. When in the switching mode, the two clearance beams rotate in a same direction as the median beam.

BRIEF DESCRIPTION OF THE DRAWINGS

These and other features of the present invention will become more apparent from the following description in which reference is made to the appended drawings wherein.

DETAILED DESCRIPTION OF THE INVENTION

The present innovation relates to a cross-over switch system for use on a guideway beam for a monorail vehicle permitting switching the vehicle between two parallel fixed guideway beams. Advantageously, the two parallel fixed guideways may be positioned closer together than with conventional cross-over switches.

Figure 1:
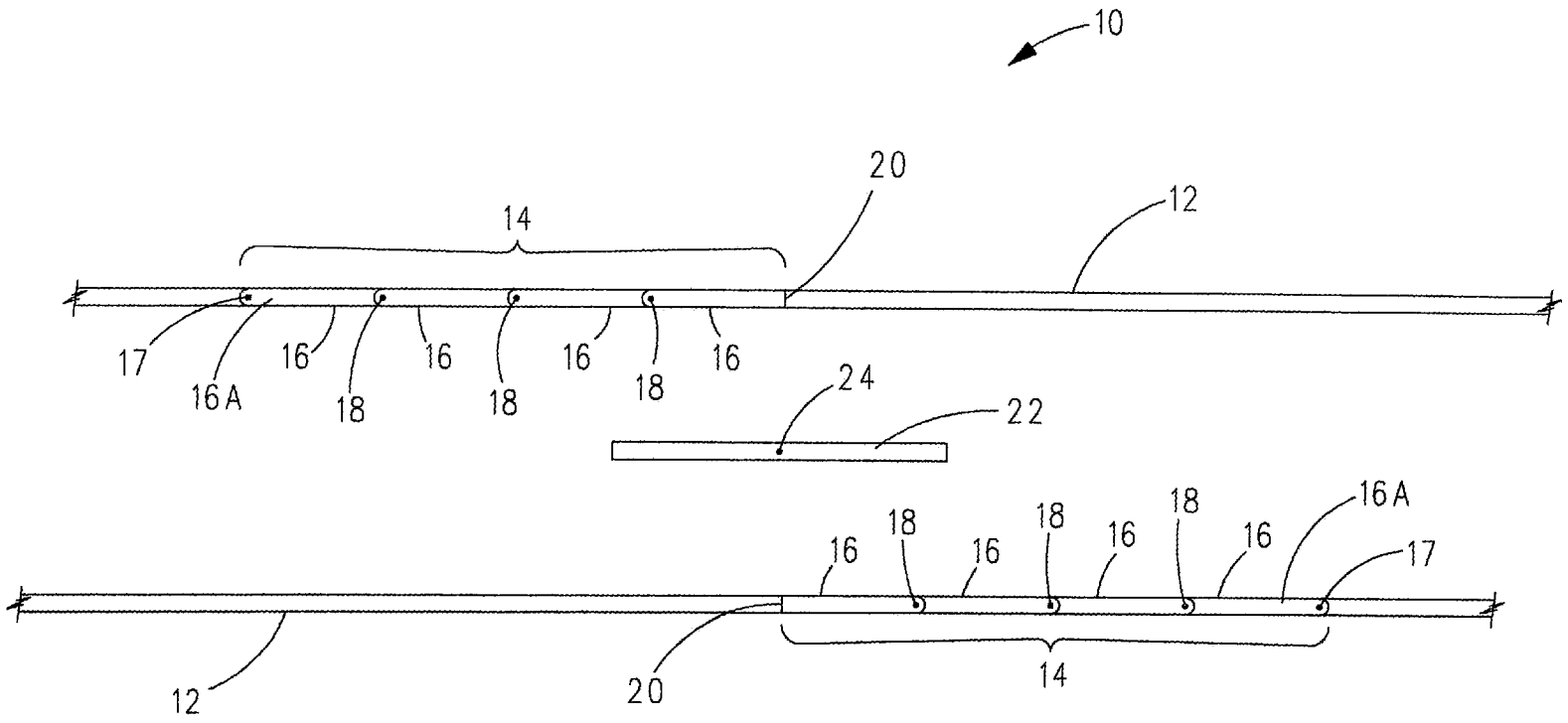
FIG. 1 is a top view of a cross-over switch system in a non-switching position in accordance with an embodiment.

FIG. 1 depicts a cross-over switch system 10 for switching a monorail vehicle between two fixed guideway beams 12. In an area where a switch system 10 is installed, the two fixed guideways beams 12 are typically straight and parallel to each other.

Figure 2:
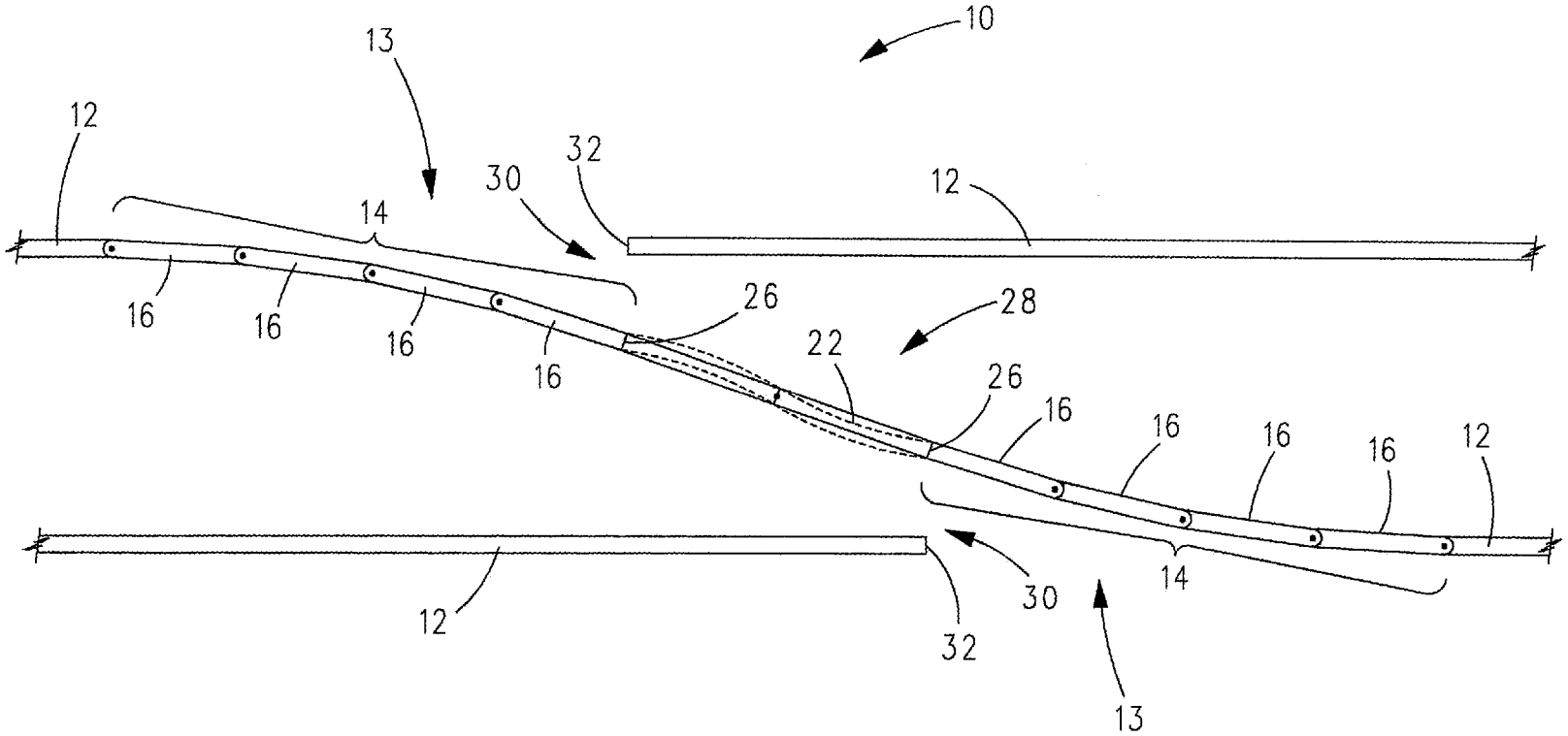
FIG. 2 is a top view of the cross-over switch system of FIG. 1 in a switching position.

Each of the two guideway beams 12 is typically continuous unless a switch system must be installed. In this case, a discontinuity 13 is provided in the otherwise continuous guideway beam 12 in order to accommodate an articulated beam 14. The discontinuities 13 are best shown in FIG. 2. Each articulated beam 14 is made of a chain of pivotably interconnected segments 16. Indeed, each segment 16 is connected to another segment 16 through a pivot 18. At pivot 17, the articulated beam 14 is pivotably connected to the guideway beam 12. At interface 20, the last segment of the articulated beam slidably engages with the fixed guideway beam 12.

The segments 16 may be made of a sturdy aluminum construction, such as an extrusion for example. Each articulated beam 14 is pivoted with the help of an electric actuator connected between the first segments 17 and the guideway beam 12. More electric actuators are used to lock in place each segment 16 when adopting either a switching or a non-switching position. Each segment 16 is restricted from further travel by the use of hard stops.

As shown in FIG. 1, the cross-over switch system 10 is in the non-switching position. In this mode, the two articulated beams 14 are aligned with their respective guideway beam 12 to which they are connected so as to each form a straight, continuous guideway beam.

A median beam 22 is located at a median distance between the two fixed guideway beams 12. As will be explained further, the median beam is capable of pivoting around a pivot 24 placed in its center. In the non-switching position of FIG. 1, the median beam 22 is parallel to the two guideway beams 12 so as to provide as much clearance as possible to each of the guideway beams 12 to allow free movement of the monorail vehicles on the guideway beams 12.

The median beam 22 is typically straight. However, it could also have a soft wave-shape or soft S-shape (as shown in phantom in FIG. 2), e.g., without limitation, in the nature of a sigmoid curve.

FIG. 2 depicts the cross-over switch system 10 in a switching position. In this mode, the median beam 22 is pivoted towards the articulated beams 14. Each segment 16 of each articulated beam 14 is also pivoted so that a swinging end 26 of each of the articulated beams 14 abuts an opposed end of the median beam 22. In this switching position, both articulated beams 14 and the median beam 22 form a continuous segmented curved beam 28 interconnecting the two parallel fixed guideway beams 12.

In the switching position, each segment 16 only pivots a few degrees with respect to its neighboring segment 16, or with respect to the guideway beam 12 for the last segment 16 connected at pivot 17. This makes for a simulated curved transition between both guideway beams 12.

It is important to make sure that a clearance 30 between the segmented curved beam 28 and an interrupted end 32 of the guideway beams 12 is sufficient to clear the monorail vehicles circulating on the segmented curved beam 28.

Figure 3:
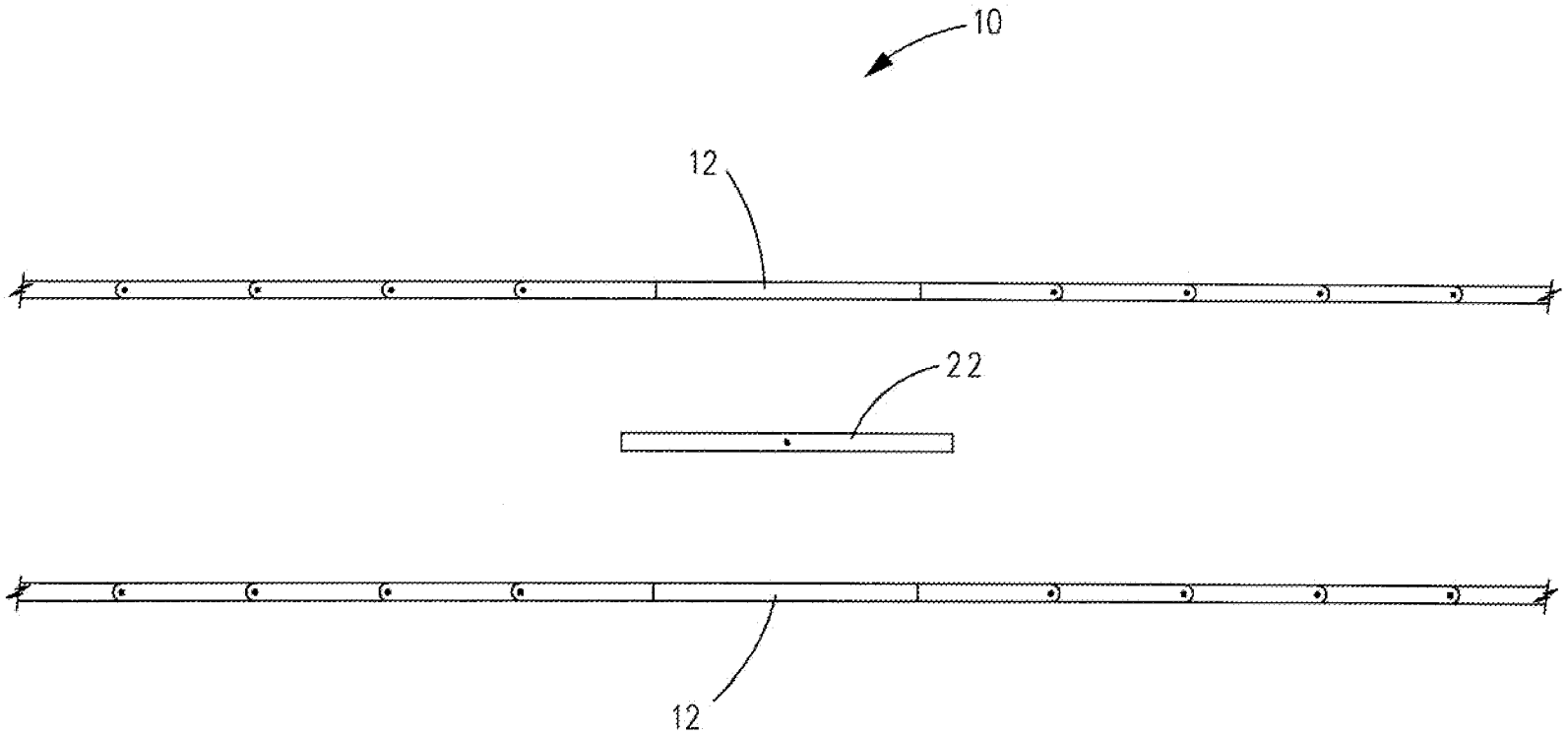
FIG. 3 is a top view of a cross-over switch system in a non-switching position in accordance with another embodiment.

FIG. 3 represents another embodiment of the cross-over switch system 10. The embodiment of FIG. 3 depicts a double cross-over switch system 10 for switching a monorail vehicle between two fixed guideway beams 12. Advantageously, with this configuration, the monorail never has to back-up for using the switch, notwithstanding in which direction the vehicle is travelling.

In this embodiment of the double cross-over switch system 10, four articulated beams 14 and one median beam 22 are used. Each of the two guideway beams 12 is equipped with two articulated beam 14. Otherwise, the articulated beams 14 and the median beam 22 are as already described.

As shown, the cross-over switch system 10 is in a non-switching position. In this mode, the four articulated beams 14 are aligned with their respective guideway beam 12 to which they are connected so as to each form a straight, continuous guideway beam while the median beam 22 is in an intermediate position between the two guideway beams 12. In the present example, the median beam 22 is parallel to at least one of the guideway beams 12.

Figure 4:
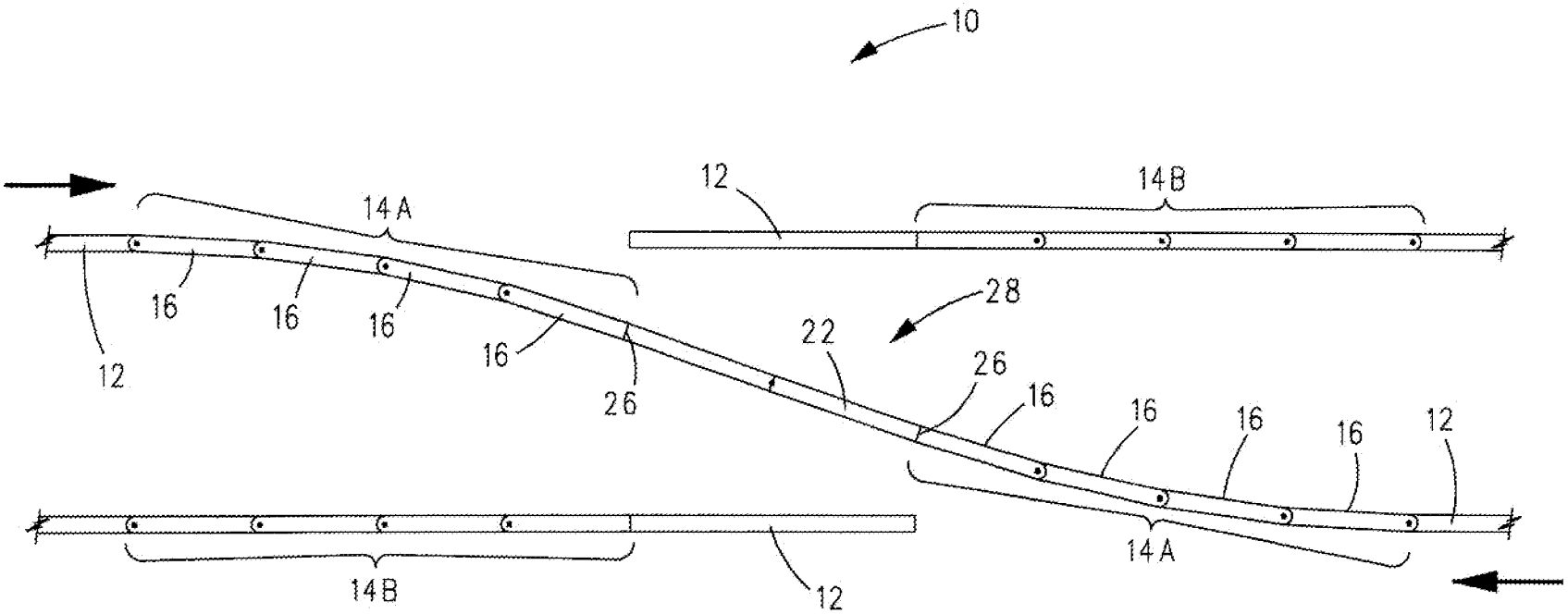
FIG. 4 is a top view of the cross-over switch system of FIG. 3 in a first switching position.

In FIG. 4, the cross-over switch system is shown in a first switching position. This switching position is adopted whenever a monorail vehicle travels in one of the two travelling directions indicated by the two arrows shown along the guideway beams 12. The median beam 22 is pivoted towards a first pair of articulated beams 14A and each segment 16 of each articulated beam 14A is also pivoted so that a swinging end 26 of each of the articulated beams 14A abuts an opposed end of the median beam 22. In this switching position, both articulated beams 14A and the median beam 22 form a continuous segmented curved beam 28 interconnecting the two parallel fixed guideway beams 12.

Figure 5:
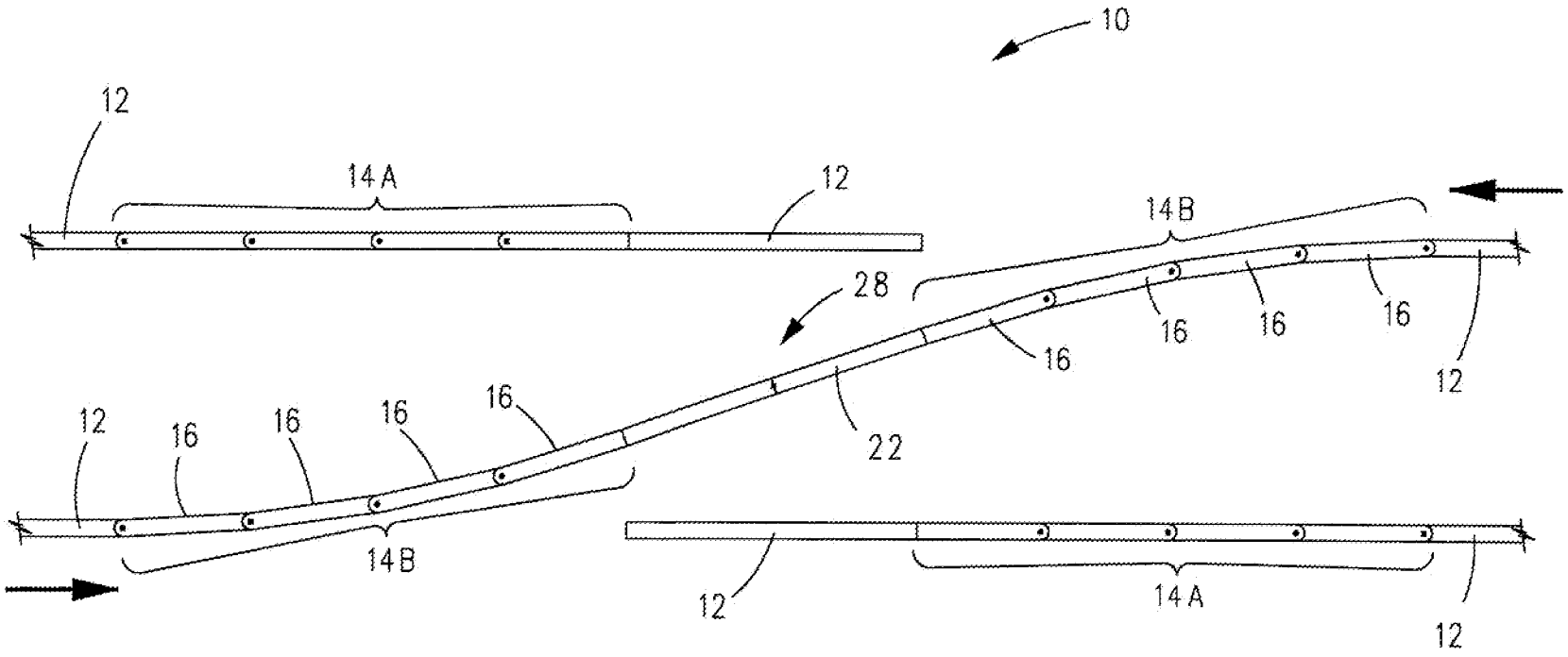
FIG. 5 is a top view of the cross-over switch system of FIG. 3 in a second switching position.

FIG. 5 depicts a second switching position of the present embodiment of the cross-over switch system 10 where a second pair of articulated beams 14B are now moved to a switching position while the other two articulated beams 14A remain aligned with their respective guideway beam 12. The median beam 22 is pivoted towards the second pair of articulated beams 14B, in a direction opposite that adopted for the first switching position of FIG. 4. Each segment 16 of each articulated beam 14B is also pivoted so that a swinging end 26 of each of the articulated beams 14A abuts an opposed end of the median beam 22. In this switching position, both articulated beams 14B and the median beam 22 form a continuous segmented curved beam 28 interconnecting the two parallel fixed guideway beams 12. This switching position is adopted whenever a monorail vehicle travels in one of the two travelling directions indicated by the two arrows shown along the guideway beams 12.

In case a large curve radius is required, but the distance between the guideway beams 12 is limited, it is possible to add a clearance segment 34 connected to the guideway 12 and adapted to move in an opposed direction to the articulated beam 14, thereby increasing clearance 30. This is depicted in FIGS. 6 and 7.

Figure 6:
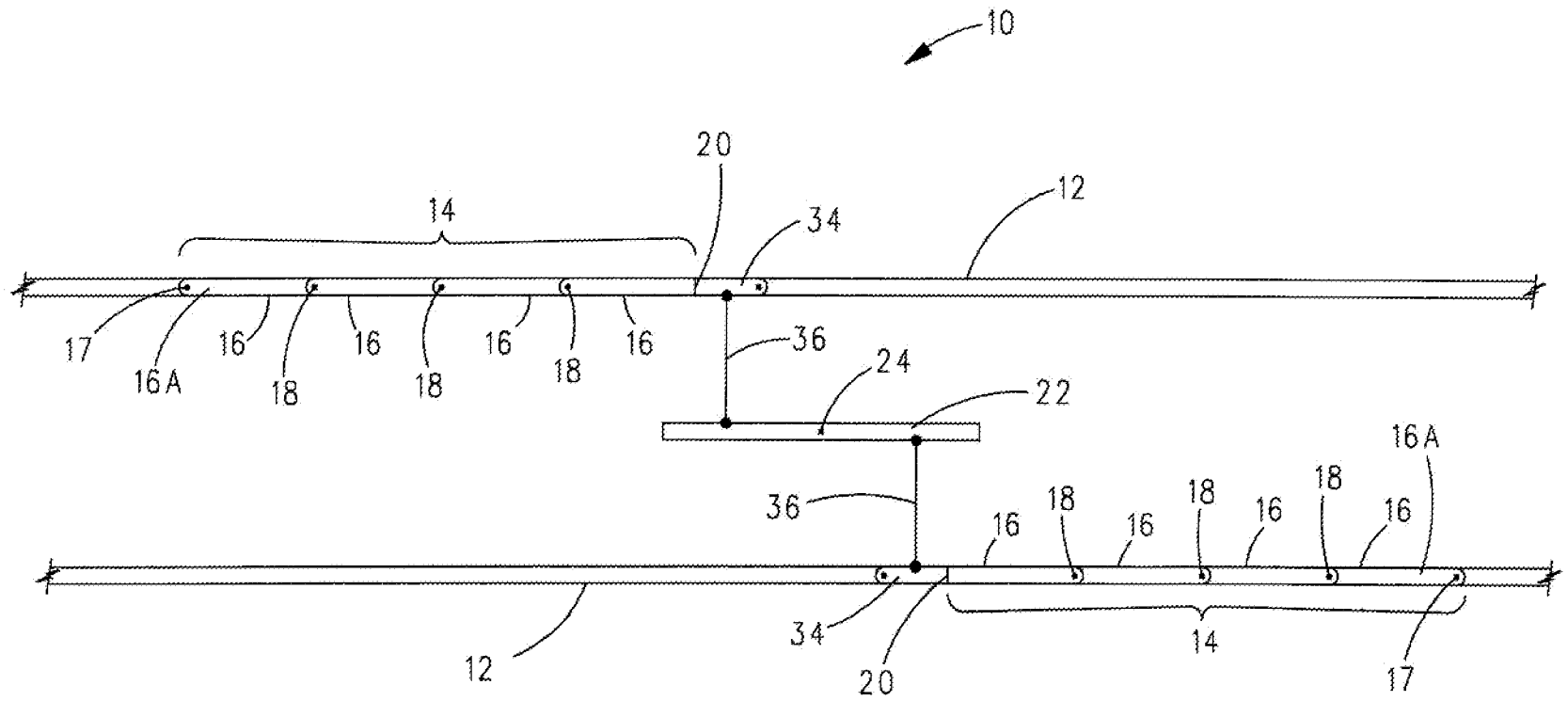
FIG. 6 is a top view of the cross-over switch system in a non-switching position in accordance with another embodiment.
Figure 7:
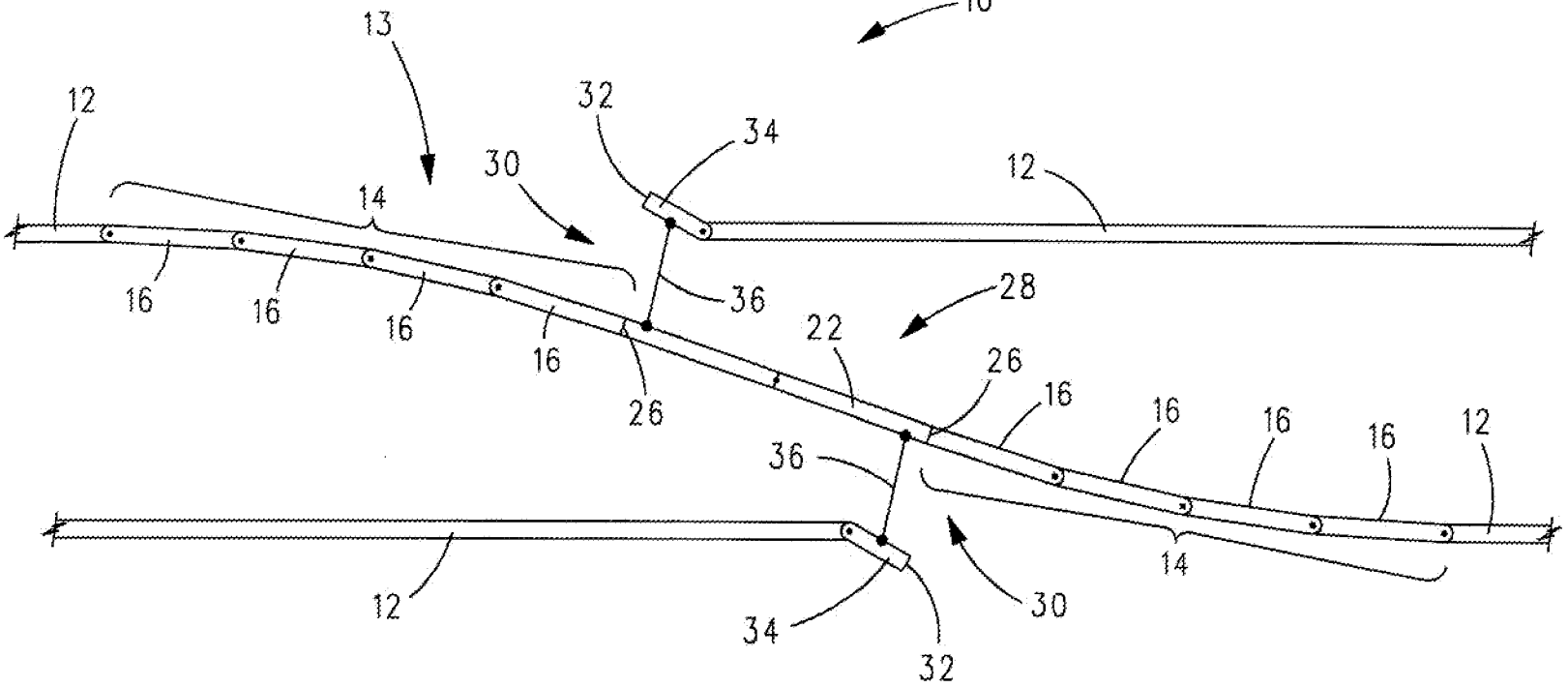
FIG. 7 is a top view of the cross-over switch system of FIG. 6 in a switching position.

In FIG. 6, the cross-over switch system 10 is shown in a non-switching position. The clearance segments 34 may be articulated directly through the use of an electric actuator between the guideway 12 and the opposed segment 34. Alternatively, a linkage 36 may be used to connect each one of the opposed segment 34 to the median beam 22. When the cross-over switch system 10 is moved to a switching position as shown in FIG. 7, both clearance segments 34 are moved away by the rotation movement of the median beam 22, thereby increasing the clearance 30.

Although not shown, these clearance segments may be used in a double cross-over switch system 10.

The present invention has been described with regard to preferred embodiments. The description as much as the drawings were intended to help the understanding of the invention, rather than to limit its scope. It will be apparent to one skilled in the art that various modifications may be made to the invention without departing from the scope of the invention as described herein, and such modifications are intended to be covered by the present description. The invention is defined by the claims that follow.

The invention claimed is:

1. A cross-over switch system for switching a monorail vehicle between two spaced fixed guideway beams, each one of the two fixed guideway beams having a discontinuity, the discontinuities being longitudinally staggered with respect to each other, the cross-over switch system comprising:

two articulated beams, each one of said two articulated beams being made of a chain of pivotably interconnected segments, each one of said two articulated beams being adapted to be pivotably connected to a different one of the two fixed guideways at an end of one respective discontinuity that is distal a median pivot point;

a median beam, said median beam being located between the two fixed guideway beams, said median beam being pivotable at said median pivot point;

two clearance segments, each clearance segment being adapted to be pivotably connected to a different one of the two fixed guideway beams at an end of the discontinuities that is proximate said median pivot point; and two linkages, each one of said two linkages being connected to an opposed longitudinal half of said median beam and to a different one of said two clearance segments, said median beam being operative to induce a rotational movement to said two clearance segments through said two linkages, wherein in a non-switching mode said median beam is in a first orientation between the two fixed guideway beams and said two articulated beams are aligned with the respective fixed guideway beam to which they are connected so as to each form a straight beam, and in a switching mode said median beam is pivoted to a second orientation and each segment of each articulated beam is pivoted so that each one of said articulated beam abuts an opposed end of said median beam, thereby forming a continuous segmented beam interconnecting the two fixed guideway beams; and wherein in the non-switching mode, said two clearance beams are aligned with the two guideway beams and wherein in the switching mode, said two clearance beams rotate in a same direction as said median beam.

2. The cross-over switch system of claim 1 wherein said segments are made of an aluminum extrusion.

3. The cross-over switch system of claim 1 wherein said median beam is straight.

4. The cross-over switch system of claim 1 wherein said median beam has the shape of a wave or an S.

5. The cross-over switch system of claim 1 wherein each one of the two fixed guideway beams has two discontinuities, said cross-over switch further comprising two pairs of articulated beams, each one of said pair of articulated beams being connected to a different one of the two fixed guideway beams, each articulated beam of each one of said two pairs of articulated beams being connected at the end of one respective discontinuity that is distal the median pivot point, thereby creating a double cross-over switch.

6. A cross-over switch system for switching a monorail vehicle between two spaced fixed guideway beams, each one of the two fixed guideway beams having a discontinuity, the discontinuities being longitudinally staggered with respect to each other, the cross-over switch system comprising:

two articulated beams, each one of said two articulated beams being made of a chain of pivotably interconnected segments, each one of said two articulated beams being adapted to be pivotably connected to a different one of the two fixed guideways at an end of one respective discontinuity that is distal a median pivot point;

a median beam, said median beam being located between the two fixed guideway beams, said median beam being pivotable at said median pivot point;

two clearance segments, each clearance segments being adapted to be pivotably connected at a different one of the two fixed guideway beams at an end of the discontinuities that is proximate said median pivot point; and two actuators, each one of said two actuators being connected to a different one of said two fixed guideways and to a corresponding one of said two clearance segments, each one of said two actuators being operative to induce a rotational movement to a respective one of said two clearance segments, wherein in a non-switching mode said median beam is in a first orientation between the two fixed guideway beams and said two articulated beams are aligned with the respective fixed guideway beam to which they are connected so as to each form a straight beam, and in a switching mode said median beam is pivoted to a second orientation and each segment of each articulated beam is pivoted so that each one of said articulated beam abuts an opposed end of said median beam, thereby forming a continuous segmented beam interconnecting the two fixed guideway beams;

wherein in the non-switching mode, said two clearance beams are aligned with the two guideway beams and wherein in the switching mode, said two clearance beams rotate in a same direction as said median beam.

7. The cross-over switch system of claim 6 wherein said segments are made of an aluminum extrusion.

8. The cross-over switch system of claim 6 wherein said median beam is straight.

9. The cross-over switch system of claim 6 wherein said median beam has the shape of a wave or an S.

10. The cross-over switch system of claim 6 wherein each one of the two fixed guideway beams has two discontinuities, said cross-over switch further comprising two pairs of articulated beams, each one of said pair of articulated beams being connected to a different one of the two fixed guideway beams, each articulated beam of each one of said two pairs of articulated beams being connected at the end of one respective discontinuity that is distal the median pivot point, thereby creating a double cross-over switch.

* * * * *